US005967907A

United States Patent [19]

Takemura et al.

[11] Patent Number: 5,967,907

[45] Date of Patent: Oct. 19, 1999

[54] MULTI-PIECE SOLID GOLF BALL

[75] Inventors: Kohei Takemura, Nara; Akihiro Nakahara, Ibaragi; Akihiko Hamada, Kakogawa, all of Japan

[73] Assignee: Sumitomo Rubber Industries, Ltd., Hyogo-ken, Japan

[21] Appl. No.: 08/958,982

[22] Filed: Oct. 28, 1997

[30] Foreign Application Priority Data

Oct. 28, 1996 [JP] Japan ..... 8-284960
Jul. 25, 1997 [JP] Japan ..... 9-199823

[51] Int. Cl.[6] ..... A63B 37/06

[52] U.S. Cl. ..... 473/373; 473/374; 273/DIG. 22

[58] Field of Search ..... 473/374, 373, 473/375, 376; 273/DIG. 22

[56] References Cited

U.S. PATENT DOCUMENTS 4,714,253 12/1987 Nakahara et al. .
5,253,871 10/1993 Viollaz .
5,439,227 8/1995 Egashira et al. .
5,688,191 11/1997 Cavallaro et al. ..... 473/374 X
5,733,974 3/1998 Yamada et al. ..... 473/374 X

FOREIGN PATENT DOCUMENTS 8-113679 5/1996 Japan .

*Primary Examiner*—George J. Marlo
*Attorney, Agent, or Firm*—Birch, Stewart, Kolasch & Birch, LLP

[57] ABSTRACT

The present invention provides a multi-piece solid golf ball having excellent durability, excellent shot feel when hitting and good productivity. The present invention relates to a multi-piece solid golf ball which includes a solid core having a inner core and at least one outer core layer formed on the inner core, and a cover covering the solid core, wherein the inner core and outer core are formed from the material obtained by dispersing rubber in an ionomer resin and dynamically vulcanizing it with a vulcanizing agent, wherein the rubber particles dispersed in the ionomer resin have a particle size of not more than 10 $\mu$m, the outer core layer has a Shore D hardness of more than that of the inner core by 5 to 30, and a weight ratio of the ionomer resin to the rubber particles is within the range of 95:5 to 30:70.

12 Claims, 1 Drawing Sheet

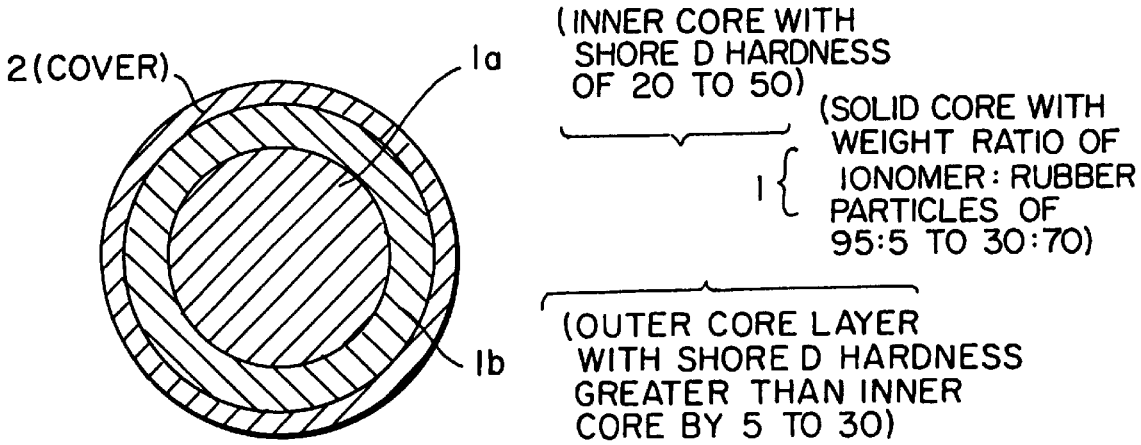
2(COVER)
1a
1b
(INNER CORE WITH SHORE D HARDNESS OF 20 TO 50)
1
(SOLID CORE WITH WEIGHT RATIO OF IONOMER: RUBBER PARTICLES OF 95:5 TO 30:70)
(OUTER CORE LAYER WITH SHORE D HARDNESS GREATER THAN INNER CORE BY 5 TO 30)

MULTI-PIECE SOLID GOLF BALL

FIELD OF THE INVENTION

The present invention relates to a multi-piece solid golf ball. More particularly, it relates to a multi-piece solid golf ball having excellent durability, good shot feel when hitting and excellent productivity.

BACKGROUND OF THE INVENTION

Solid golf balls are typically classified into one-piece golf ball and two-piece solid golf ball, the two-piece solid golf ball is generally approved or employed by amateur golfers. The two-piece solid golf ball is composed of a solid core of molded rubber material and a cover typically formed from ionomer resin. The two-piece solid golf ball exhibits long flight distance, but shows poor shot feel when hitting. The two piece solid golf ball is so hard that it is difficult to apply spin on the two-piece solid golf ball and that it is difficult to control it when hitting by an iron club or at approach shot.

In order to improve the shot feel and controllability of the two-piece solid golf ball, a multi-piece solid golf ball comprising a core having two or more layers has been proposed (Japanese Patent Kokai Publication No. 194760/1984). The solid core is generally formed from a rubber composition, and it is difficult to form the rubber composition in two or more layers and in a concentric sphere. Therefore, it is not suitable to mass production.

In order to solve the problem, a multi-layer core comprising of a center (an inner core) formed from rubber composition and an outer core formed on the inner core from thermoplastic resin has been proposed (Japanese Patent Kokai Publication Nos. 244174/1992 and 142228/1994). When using thermoplastic resin, the outer core can be formed on the center of the core uniformly and in a concentric sphere, but the core has poor impact resistance when hitting repeatedly and poor form stability because of using thermoplastic resin. In some cases, the use of the thermoplastic resin has a problem in adhesion properties between ionomer resin which has been typically used for the cover of golf balls and the thermoplastic resin used for the outer core. In this case, energy loss occurs in the interface between the outer core and the cover, which leads to the reduction of flight distance.

OBJECTS OF THE INVENTION

A main object of the present invention is to provide a multi-piece solid golf ball having excellent durability, good shot feel when hitting and excellent productivity.

According to the present invention, the object described above has been accomplished by the selection of the multi-layer core material, thereby providing a multi-piece solid golf ball having excellent durability, good shot feel when hitting and easiness of producing.

SUMMARY OF THE INVENTION

The present invention provides a multi-piece solid golf ball comprising a solid core consisting of an inner core and at least one outer core layer formed on the inner core, and a cover covering the solid core, wherein the inner core and outer core are formed from the material obtained by dispersing rubber in an ionomer resin and dynamically vulcanizing it with a vulcanizing agent, the rubber particles dispersed in the ionomer resin have a particle size of not more than 10 $\mu$m, the outer core has a Shore D hardness of more than that of the inner core by 5 to 30, a weight ratio of the ionomer resin to the rubber particles is ranged within 95:5 to 30:70.

BRIEF DESCRIPTION OF DRAWING

The Figure shows one embodiment of the golf ball of the present invention which includes a solid core (1) which constitutes an inner core (1*a*) and an outer core layer (1*b*), as well as a cover (2) covering the solid core.

DETAILED DESCRIPTION OF THE INVENTION

The present inventors have previously proposed the material obtained by dispersing rubber in an ionomer resin and dynamically vulcanizing it with a vulcanizing agent (Japanese Patent Kokai Publication No. 113679/1996). When the dynamically vulcanized material dynamically vulcanized is used in solid golf ball, particularly the inner core and outer core of a multi-piece solid golf ball, it has been found to impart excellent characteristics to the golf ball. Herein, the term "dynamic vulcanization" means a vulcanization conducted by dispersing a rubber component in thermoplastic resin (ionomer resin for the present invention) and adding a vulcanizing agent thereto. The material obtained by the dynamic vulcanization is a material having the characteristics of both thermoplastic resin and rubber, that is, vulcanized rubber having thermoplasticity.

The dynamically vulcanized material of the present invention contains vulcanized rubber particles micro-dispersed in the ionomer resin, and the vulcanized rubber particles disperse and absorb the impact force given from the exterior to enhance the impact resistance and durability of the resulting golf ball. Since the material is very compatible with the ionomer resin which has been typically used for the cover of golf balls because of the presence of ionomer resin, and has good adhesion between the cover and the outer core, the flight distance of the resulting golf ball is not degraded by energy loss. The material can also be injection-molded because of the characteristics of thermoplastic resin, thus the productivity of the golf ball is extremely improved. If the material is melted again after collecting, it can be molded again because of the thermoplasticity. Therefore, dynamic vulcanized material can be recycled. The material is very useful, because environmental problems have recently become important and recycling has been desired.

The ionomer resin is not limited, but includes an ionomer resin which has been typically used for the cover of golf balls. The ionomer resin may be a copolymer of an $\alpha,\beta$-ethylenically unsaturated carboxylic acid, an olefin, and optionally another acrylic monomer, of which a portion of carboxylic acid groups is neutralized with metal ion. The metal ion which neutralizes a portion of carboxylic acid groups of the copolymer includes alkali metal ion (such as sodium ion, potassium ion, lithium ion and the like), divalent metal ion (such as zinc ion) and the like. As the ionomer resin, one which is commercially available is practically used. Examples of the ionomer, which is commercially available, are not limited, but examples thereof will be shown by trade names. Examples of the ionomer resin, which is commercially available from Mitsui Du Pont Polychemical Co., include Hi-milan 1605 (ethylene-methacrylic acid copolymer ionomer resin neutralized with sodium ion), Hi-milan 1707 (ethylene-methacrylic acid copolymer ionomer resin neutralized with sodium ion), Hi-milan 1706 (ethylene-methacrylic acid copolymer ionomer resin neutralized with zinc ion), Hi-milan AM7315 (ethylene-methacrylic acid copolymer ionomer resin neutoralized with zinc ion), Hi-milan AM7317 (ethylene-methacrylic acid copolymer ionomer resin neutoralized with zinc ion), Hi-milan 1555 (ethylene-methacrylic acid copolymer ionomer resin neutoralized with sodium ion), Hi-milan 1557 (ethylene-methacrylic acid copolymer ionomer resin neutoralized with sodium ion). Examples of the ionomer resin, which is commercially available from Exxon Chemical Co., include Iotek 7010 (ethylene-methacrylic acid copolymer ionomer resin neutoralized with zinc ion), Iotek 8000 (ethylene-methacrylic acid copolymer ionomer resin neutoralized with sodium ion), and the like. Examples of the ionomer resin, which is commercially available from Du Pont Co., include Surlyn AD8511 (ethylene-methacrylic acid copolymer ionomer resin neutoralized with zinc ion), Surlyn AD8512 (ethylene-methacrylic acid copolymer ionomer resin neutoralized with sodium ion) and the like. These ionomer resins are used alone or in combination.

The rubber component of the present invention may be a diene rubber known to the art, such as ethylene-propyrene-diene rubber (EPDM), butadiene rubber (BR), isoprene rubber (IR), styrene-butadiene rubber (SBR), nitrile-butadiene rubber (NBR) and the like. Preferred is the diene rubber which is compatible with the ionomer resin, for example ethylene-propylene-diene rubber (EPDM) and butadiene rubber (BR).

The dynamic vulcanization is conducted by formulating a vulcanizing agent during mixing the ionomer with the rubber component. The vulcanizing agent can be one which does not crosslink thermoplastic resin (i.e. ionomer resin), that is, vulcanizing agents other than peroxide. Typical examples of the vulcanizing agents are sulfur, vulcanization accelerator, a combination of sulfur and vulcanization accelerator, oxime, resin vulcanizing agent, and the like. Examples of the vulcanization accelerator are not limited, but include dibenzothiadyl disulfide, N,N'-dicyclohexyl-2-benzothiadylsulfenamide, hexamethylenetetramine, mercaptbenzothiazole, tetramethylthiuram disulfide, tetraethylthiuram disulfide, tetrabutylthiutam disulfide, and the like. Examples of the oxime include p-quinone dioxime, p,p'-dibenzoyl quinone dioxime and the like. Examples of the resin vulcanization agent include alkylphenol formaldehyde resin and the like.

A weight ratio of the ionomer to the rubber component is suitably ranged within 95:5 to 30:70, particularly 90:10 to 40:60. When the amount of the ionomer resin is larger than 95% by weight, an effect of adding the rubber component reduces and elastic recovery and shot feel when hitting are degraded. On the other hand, the amount of the ionomer resin is smaller than 30% by weight, rebound characteristics are degraded, and it is difficult to prepare the solid core by injection molding, which is one of the characteristics of to the present invention, because the rubber content increases. The amount of the rubber component is larger than 80% by weight, resin flowability is degraded during injection molding, and thus a suitable core can not be prepared.

An amount of the vulcanizing agent for dynamic vulcanization is 0.1 to 10 parts by weight, preferably 0.3 to 5 parts by weight, based on 100 parts by weight of the rubber component. When the amount of the vulcanizing agent is smaller than 0.1 parts by weight, it is difficult to reduce the rubber particle size because the dynamic vulcanization is not be sufficiently conducted. On the other hand, the amount of the vulcanizing agent is larger than 10 parts by weight, the excess of the vulcanizing agent is unnecessary for the vulcanization and causes the bloom of the vulcanizing agent.

The system comprising the ionomer resin, the rubber component and the vulcanizing agent may optionally contain fillers, processing aids, plasticizers and the like, in order to obtain the desired physical properties.

The mixing temperature, that is, dynamic vulcanization temperature, of the formulations containing the vulcanizing agent is preferably between a temperature 20° C. lower than the activation temperature of the vulcanizing agent and 250° C. For example, when using the combination of sulfur and vulcanization accelerator, the dynamic vulcanization temperature is preferably 130 to 250° C. because the activation temperature is generally about 150° C. When using oxime type vulcanizing agent, the dynamic vulcanization temperature is preferably 160 to 250° C. because the activation temperature is generally about 180° C. When the dynamic vulcanization temperature is lower than the above range, the vulcanization of the rubber can not sufficiently advance, or if the valcanization occurs, working efficiency is degraded because the vulcanization rate is low. On the other hand, when the dynamic vulcanization temperature is higher than the above range, the degradation of the rubber adversely accurs, and thus it is difficult to improve the elastic recovery, such as elongation set.

The method of mixing the formulations can be conducted a mixing machine, such as a kneader, a Banbury mixer, an extruder, a mixing roll and the like. The kneader, the extruder and the like are particularly preferable because they put larger shearing force.

The fillers may be mixed to the formulations during the dynamic vulcanization, or to the diene rubber in advance. If possible, the ionomer resin and the rubber component may be preliminary mixed by a mixing roll, a kneader, a Banbury mixer, an extruder and the like, and then the mixture may be dynamically vulcanized.

When dynamically vulcanizing, the dynamic vulcanization is preferably terminated immediately before or immediately after the torque of the mixing machine is stabilized after increasing by vulcanizing the rubber component reducing. The dynamic vulcanization may be terminated at any time after the torque during dynamic vulcanization has a value of not less than B, defined by the following formula:

$$B=100+(10\times A)$$

wherein a torque before dynamic vulcanization is 100, and a weight ratio of the rubber component to the ionomer resin is A:

$$A=W_R/(W_I+W_D)$$

wherein $W_R$ represents a weight of the rubber component, $W_I$ represents a weight of the ionomer resin, and $W_D$ represents a weight of the diene type rubber. Here in after, the torque B will be referred to an ideal torque ratio. It is particularly preferable that the dynamic vulcanization is terminated before the torque exceeds the ideal torque ratio B and arrives at a maximum value. However, it is not always limited to the above conditions, if an average particle size of the rubber particles is not more than 10 μm, preferably 0.001 to 5 μm.

In the present invention, the vulcanized rubber particles dispersed in the ionomer resin has an average particle size of not more than 10 μm, preferably not more than 5 μm, more preferably not more than 2.5 μm. When the average particle size is less than 10 μm, elastic recovery such as elongation set is not sufficiently improved, and the high mechanical strength of the ionomer resin does not maintain and durability is degraded. The larger the particle size, the less the impact absorption is degrade. The particle size is determined by measuring a longer diameter and a shorter diameter of each of 50 particles from an image observed by a SEM (scanning electron microscope), and calculating the number average thereof. Prior to the observation, the samples are surface finished and stained with osmium oxide.

In order to improve the elastic recovery and prevent the mechanical strength from degrading, it is preferable that the particle size of the vulcanized rubber particles is as large as possible. However, the particle size is too small to improve the elastic recovery because the elastic recovery of the thermoplastic elastomer is similar to that of the ionomer resin. Therefore, the vulcanized rubber particles preferably have an average particle size of not less than 0.001 $\mu$m, more preferably not less than 0.01 $\mu$m in practical use.

It is suitable to control the termination of the dynamic vulcanization by the torque value, as explained above. However, in view of a period for mixing, it is typically about 1 to 60 minutes, and for example, it is about 2 to 30 minutes when using the combination of sulfur and the vulcanizing agent, and about 2 to 30 minutes when using the oxime type vulcanizing agent, although it largely depends on type of vulcanizing agent, formulation, an amount of formulations and the like.

It is preferable that the above dynamic vulcanized material is press molded in a mold having the same size as the inner core, or injection molded to form the inner core, and then the outer core material is injection molded around the inner core. If productivity is not considered an important, the outer core may be also formed by press molding and the like. The outer diameter of the inner core is preferably 25 to 35 mm, more preferably 28 to 32 mm. When the diameter is smaller than 25 mm, spin amount (controllability) is degraded. On the other hand, when the diameter is larger than 35 mm, the durability of the outer core is degraded, and it is difficult to prepare the solid core because of reducing the thickness of the outer core. The total core diameter after covering with the outer core is preferably 35 to 45 mm, more preferably 36 to 39 mm. When the total core diameter is smaller than 35 mm, shot feel when hitting is hard and poor. On the other hand, when the total core diameter is larger than 45 mm, feel shot is too soft. Therefore, the durability of the resulting golf ball is degraded. It is preferable that the thickness of the outer core is typically 1.5 to 15 mm. When the thickness is smaller, the technical effects of the outer core are not obtained and it is difficult to prepare the solid core. When the thickness is larger, the techinical effect of the inner core and the sufficient characteristics such as durability are not obtained.

The core for the multi-piece solid golf ball of the present invention is composed of the inner core and the outer core (it may have two or more layer structure) as described above, the inner core has a Shore D hardness of 20 to 50, preferably 25 to 45, and the outer core has a Shore D hardness higher than that of the inner core by 5 to 30, preferably 10 to 30. When a rigidity is higher, flight distance increases, but shot feel is degraded. On the other hand, when the rigidity is lower, shot feel is good, but flight distance reduces. This is in the relation of antinomy, but flight distance is mainly depended on the hardness of the outer core. The hardness of the inner core is lower, shot feel is better. Therefore, when Shore D hardness of the outer core is higher than that of the inner core by not less than 5, flight distance can be compatible with shot feel. When Shore D hardness of the outer core is higher than that of the inner core by more than 30, the durability of the resulting golf ball is degraded because shear strain between the outer core and the inner core is large. Therefore, it is desirable that Shore D hardness of the outer core is higher than that of the inner core by not more than 25, preferably not more than 20.

The above difference in hardness between the outer core and the inner core is easily obtained by selection of the type of ionomer used and rubber component used, and by controlling a mixing ratio of each components and an amount of vulcanizing agent.

The multi-piece solid golf ball of the present invention is obtained by covering the resulting core as described above with a cover material generally used for solid golf balls. The cover is generally formed from an ionomer resin, but is not be limited thereto. However, it is very suitable to use ionomer resin for adhesion between the core and cover and the like, because the core is formed from a core material comprising ionomer resin and rubber component by dynamically vulcanizing the material. Examples of the ionomer resin used for the cover material include the same ionomer resins as described above for the material used in dynamic vulcanization. Preferred are Hi-milan 1605, Hi-milan 1706, Hi-milan 1707, Hi-milan AM7315, Hi-milan AM7317 and the like, which is commercially available from Mitsui Du Pont Polychemical Co., Ltd.

The cover used in the present invention may optionally contain pigments and the other additives. Examples of the pigment generally include zinc oxide and the like, in case of white golf ball. Examples of the additive generally include a UV absorber and the like. An amount of the additive or pigment is not more than 10% by weight, preferably 0.2 to 8% by weight, because the cover is mainly formed from ionomer resin.

The cover may be covered by injection molding, because it is thermoplastics, such as ionomer resin.

When forming the cover, many depressions called "dimples" are generally formed on the cover. The dimples are formed in order to improve flight performance of the resulting golf ball.

The golf ball having a dimpled cover is provided marking stamp on it, and then coated with paint, to finish for serving commercial sell. In case of white golf ball, the paint comprises a white enamel paint and a clear paint coated on the white paint. It is well known in the art that paints of the other color may be coated.

EXAMPLES

The following Examples and Comparative Examples further illustrate the present invention in detail but are not to be construed to limit the scope thereof.

(Examples 1 to 15 and Comparative Examples 1 to 7)

Production of Cores

The inner core composition and outer core composition described in Tables 1 to 5 were dynamically vulcanized as follows. The formulation materials described above were dynamically vulcanized at 180° C. with mixing by a kneader. The dynamic vulcanized samples were ground to 1 to 3 mm, and then pressed in sheet for 15 minutes at 170° C. to obtain samples for measuring physical properties. The ionomer resin, rubber component and vulcanizing agent described in Tables 1 to 5 were as follows.

Ionomer Resin

50:50 mixture of Hi-milan 1605 and Hi-milan 1706 (both manufactured by Mitsui Du Pont Polychemical Co., Ltd.)

Rubber Component

EPDM: Esprene 505 manufactured by Sumitomo Chemical Co., Ltd.

BR: BR 11 manufactured by Japan Synthetic Rubber Co., Ltd.

Vulcanizing Agent

Bromonated alkylphenol formaldehyde

The particle size of the rubber component in the sample was measured. The particle size was determined by taking a photograph of a reflecting electron image of the sample using a scanning electron microscope (T-220A manufactured by JEOL Co., Ltd.), and measuring a length in vertical direction of 50 random rubber particles to calculate the number average thereof as average particle size.

The particle size can not be determined in Comparative Example 5, because the ionomer resin and the rubber component form continuous phase because they are not dynamically vulcanized.

The inner core was produced by using the dynamically vulcanized composition as follows, and then the outer core composition was covered on the inner core to form a solid core for golf ball.

Production of Inner and Outer Cores

The inner cores were produced by injection molding. The injection temperature was about 210° C. Each outer core was produced by preliminary molding into semi-spherical half-shells, encapsuling the resulting inner core with the two half-shells, followed by press-molding in a mold. The half-shell was produced at 200° C., and the press-molding was conducted at 160° C. Shore D hardness of the inner core and the outer core was measured , and the results are shown in Tables 1 to 5. Diameter of the inner core and diameter after covering it with the outer core were also shown in Tables 1 to 5. Comparative Example 2 was a two-piece solid golf ball commercially available and Comparative Example 3 was a three-piece solid golf ball commercially available as described above, thus the measurement thereof was not conducted.

A cover composition shown in the following formulation was prepared, and a cover was formed on the resulting solid core by injection molding the cover composition. A thickness of the cover is shown in Tables 1 to 5. A weight of the resulting golf ball is also shown in Tables 1 to 5.

(Formulation of Cover)

| | |
|---|---|
| Hi-milan 1605 | 50 parts by weight |
| Hi-milan 1706 | 50 parts by weight |
| Titanium dioxide | 2 parts by weight |

Flight distance, durability and shot feel were measured or evaluated, and the results are shown in Tables 1 to 3 (Examples), Tables 4 to 5 (Comparative Examples). The test methods are as follows.

Test Method (1) Flight distance

After a No. 1 wood club (W#1) was mounted to a swing robot manufactured by True Temper Co. and six golf balls were hit at a head speed of 45 m/sec respectively, flight distance was measured. As the flight distances, carry which was a distance to the dropping point of the hit golf ball was measured. The results is shown as average thereof.

(2) Durability

A golf ball was put into a tube, and fired by air to strike against an impact board at a speed of 45 m/sec, repeatedly. The durability is the number of strike until the golf ball cracks, and is indicated by an index when that of a conventional two-piece golf ball (Comparative Example 2) is 100.

(3) Shot feel

The shot feel of the golf ball is evaluated in 5 steps by 5 golfers according to a practical hitting test using a No. 1 wood club under the condition of the winter season (0° C.) that impact when hitting particularly has an large effect on it (5: soft and good, 1: hard and poor). The shot feel is indicated as the average of the score evaluated by 5 golfers, which primarily evaluated for softness when hitting. The average head speed of 5 golfers is 41 m/sec.

TABLE 1

| | Example | | | | |
|---|---|---|---|---|---|
| Item | 1 | 2 | 3 | 4 | 5 |
| (Inner core) Formulation | | | | | |
| Ionomer | 30 | 30 | 45 | 45 | 45 |
| Rubber (EPDM) | 70 | 70 | 55 | 55 | 55 |
| Vulcanizing agent | 0.7 | 0.7 | 0.8 | 0.8 | 0.8 |
| Hardness (a) | 25 | 25 | 35 | 35 | 35 |
| Particle size of rubber (μm) | 0.82 | 0.82 | 1.64 | 1.64 | 1.64 |
| (Outer core) Formulation | | | | | |
| Ionomer | 45 | 60 | 60 | 90 | 95 |
| Rubber (EPDM) | 55 | 40 | 40 | 10 | 5 |
| Vulcanizing agent | 0.8 | 0.4 | 0.4 | 0.1 | 0.1 |
| Hardness (b) | 35 | 45 | 45 | 58 | 62 |
| Particle size of rubber (μm) | 1.64 | 2.09 | 2.09 | 2.11 | 2.49 |
| Difference in hardness (a–b) | 10 | 20 | 10 | 23 | 27 |
| Diameter of inner core (mm) | 28 | 30 | 32 | 32 | 32 |
| Diameter of core (mm) | 38.0 | 38.0 | 38.0 | 38.0 | 38.0 |
| Thickness of outer core (mm) | 5.0 | 4.0 | 3.0 | 3.0 | 3.0 |
| Thickness of cover (mm) | 2.4 | 2.4 | 2.4 | 2.4 | 2.4 |
| Weight of ball (g) | 45.2 | 45.2 | 45.3 | 45.3 | 45.2 |
| Flight distance (yard) | 219 | 221 | 222 | 225 | 225 |
| Durability | 135 | 121 | 133 | 129 | 126 |
| Shot feel | 5 | 5 | 5 | 4 | 4 |

TABLE 2

| | Example | | | | |
|---|---|---|---|---|---|
| Item | 6 | 7 | 8 | 9 | 10 |
| (Inner core) Formulation | | | | | |
| Ionomer | 60 | 60 | 38 | 45 | 50 |
| Rubber (EPDM) | 40 | 40 | 62 | 55 | — |
| Rubber (BR) | — | — | — | — | 50 |
| Vulcanizing agent | 0.4 | 0.4 | 1.2 | 0.8 | 0.8 |
| Hardness (a) | 45 | 45 | 30 | 35 | 35 |
| Particle size of rubber (μm) | 2.09 | 2.09 | 1.33 | 1.64 | 0.96 |
| (Outer core) Formulation | | | | | |
| Ionomer | 90 | 95 | 65 | 90 | 90 |
| Rubber (EPDM) | 10 | 5 | 35 | — | 10 |
| Rubber (BR) | — | — | — | 10 | — |
| Vulcanizing agent | 0.1 | 0.1 | 0.7 | 0.1 | 0.1 |
| Hardness (b) | 58 | 62 | 50 | 60 | 58 |
| Particle size of rubber (μm) | 2.11 | 2.49 | 2.12 | 1.32 | 2.11 |
| Difference in hardness (a–b) | 13 | 17 | 20 | 25 | 23 |
| Diameter of inner core (mm) | 33 | 35 | 32 | 32 | 32 |
| Diameter of core (mm) | 38.0 | 39.5 | 38.0 | 38.0 | 38.0 |
| Thickness of outer core (mm) | 2.5 | 2.0 | 3.0 | 3.0 | 3.0 |
| Thickness of cover (mm) | 2.4 | 1.90 | 2.4 | 2.4 | 2.4 |
| Weight of ball (g) | 45.3 | 45.4 | 45.3 | 45.4 | 45.4 |
| Flight distance (yard) | 226 | 226 | 224 | 226 | 228 |
| Durability | 135 | 130 | 130 | 118 | 129 |
| Shot feel | 4 | 4 | 5 | 4 | 4 |

TABLE 3

| Item | Example 11 | 12 | 13 | 14 | 15 |
|---|---|---|---|---|---|
| (Inner core) Formulation | | | | | |
| Ionomer | 50 | 45 | 45 | 50 | 30 |
| Rubber (EPDM) | — | 55 | 55 | 50 | 70 |
| Rubber (BR) | 50 | — | — | — | — |
| Vulcanizing agent | 0.8 | 0.8 | 0.8 | 0.6 | 0.7 |
| Hardness (a) | 35 | 35 | 35 | 40 | 25 |
| Particle size of rubber (μm) | 0.96 | 4.98 | 10.1 | 1.88 | 0.82 |
| (Outer core) Formulation | | | | | |
| Ionomer | 90 | 60 | 60 | 60 | 80 |
| Rubber (EPDM) | — | 40 | 40 | 40 | 20 |
| Rubber (BR) | 10 | — | — | — | — |
| Vulcanizing agent | 0.1 | 0.4 | 0.4 | 0.4 | 0.2 |
| Hardness (b) | 60 | 45 | 45 | 45 | 55 |
| Particle size of rubber (μm) | 1.32 | 5.02 | 10.2 | 2.09 | 2.10 |
| Difference in hardness (a–b) | 25 | 10 | 10 | 5 | 30 |
| Diameter of inner core (mm) | 32 | 32 | 32 | 32 | 32 |
| Diameter of core (mm) | 38.0 | 38.0 | 38.0 | 38.0 | 38.0 |
| Thickness of outer core (mm) | 3.0 | 3.0 | 3.0 | 3.0 | 3.0 |
| Thickness of cover (mm) | 2.4 | 2.4 | 2.4 | 2.4 | 2.4 |
| Weight of ball (g) | 45.4 | 45.3 | 45.3 | 45.3 | 45.4 |
| Flight distance (yard) | 228 | 222 | 221 | 221 | 225 |
| Durability | 118 | 130 | 125 | 134 | 120 |
| Shot feel | 4 | 5 | 4 | 4 | 5 |

TABLE 4

| Item | Comparative Example 1 | 2 | 3 | 4 |
|---|---|---|---|---|
| (Inner core) Formulation | | | | |
| Ionomer | 45 | * | ** | 45 |
| Rubber (EPDM) | 55 | | | 55 |
| Vulcanizing agent | 0.8 | | | 0.8 |
| Hardness (a) | 35 | | | 35 |
| Particle size of rubber (μm) | 13.5 | | | 1.64 |
| (Outer core) Formulation | | | | |
| Ionomer | 60 | * | ** | 99 |
| Rubber (EPDM) | 40 | | | 1 |
| Vulcanizing agent | 0.4 | | | 0.03 |
| Hardness (b) | 45 | | | 56 |
| Particle size of rubber (μm) | 12.0 | | | 3.20 |
| Difference in hardness (a–b) | 10 | | | 21 |
| Diameter of inner core (mm) | 32 | | | 32 |
| Diameter of core (mm) | 38.0 | | | 38.0 |
| Thickness of outer core (mm) | 3.0 | | | 3.0 |
| Thickness of cover (mm) | 2.4 | | | 2.4 |
| Weight of ball (g) | 45.2 | 45.2 | 45.3 | 45.3 |
| Flight distance (yard) | 220 | 218 | 201 | 225 |
| Durability | 103 | 100 | 72 | 129 |
| Shot feel | 3 | 2 | 3 | 2 |

*Two-piece golf ball commercially available
**Three-piece golf ball commercially available

TABLE 5

| Item | Comparative Example 5 | 6 | 7 |
|---|---|---|---|
| (Inner core) Formulation | | | |
| Ionomer | 50 | 50 | 65 |
| Rubber (EPDM) | 55 | 50 | 35 |
| Vulcanizing agent | — | 0.6 | 0.7 |
| Hardness (a) | 31 | 40 | 50 |
| Particle size of rubber (μm) | *** | 1.88 | 2.12 |
| (Outer core) Formulation | | | |
| Ionomer | 70 | — | 38 |
| Rubber (EPDM) | 30 | — | 62 |
| Vulcanizing agent | — | — | 1.2 |
| Hardness (b) | 46 | 40 | 30 |
| Particle size of rubber (μm) | *** | 1.88 | 1.33 |
| Difference in hardness (a–b) | 15 | 0 | −20 |
| Diameter of inner core (mm) | 32 | 32 | 32 |
| Diameter of core (mm) | 38.0 | 38.0 | 38.0 |
| Thickness of outer core (mm) | 3.0 | 3.0 | 3.0 |
| Thickness of cover (mm) | 2.4 | 2.4 | 2.4 |
| Weight of ball (g) | 45.1 | 45.3 | 45.3 |
| Flight distance (yard) | 203 | 218 | 199 |
| Durability | 60 | 135 | 121 |
| Shot feel | 1 | 4 | 3 |

*The rubber component is laminar, which is not particulate.

As is apparent from the results Tables 1 to 5, the golf balls of the present invention (Examples 1 to 15) which the inner core and outer core consist of the composition dynamically vulcanized by the vulcanizing agent, have excellent flight distance, excellent durability and good shot feel, in comparison with a conventional two-piece solid golf ball (Comparative Example 2) and a conventional three-piece solid-golf ball (Comparative Example 3). The golf balls of Examples 4, 9, 10 and 11 have the approximately same core hardness, and comprise the different rubber component.

TABLE 6

| Example No. | Hardness: Inner core | Hardness: Outer core | Rubber component: Inner core | Rubber component: Outer core |
|---|---|---|---|---|
| 4 | 35 | 58 | EPDM | EPDM |
| 9 | 35 | 60 | EPDM | BR |
| 10 | 35 | 58 | BR | EPDM |
| 11 | 35 | 60 | BR | BR |

When comparing with Examples described above, in the golf balls comprising the core having the approximately same hardness, the golf ball comprising the core used BR as the rubber component has higher rebound characteristics and longer flight distance than one comprising the core used EPDM. However, EPDM has better compatibility with the ionomer resin than BR, and has higher adhesion strength to the ionomer resin than BR. Therefore, when BR is used in the outer core, durability of the outer core, and durability between the outer core and the ionomer cover are degraded. Durability of the golf balls of Examples 9 and 11 are less than that of Examples 4 and 11. As is apparent from these results, it is most suitable to use EPDM in the outer core, and to use BR in the outer core.

In Comparative Example 1, the particle size of the dynamically vulcanized rubber particles is large, which is more than 10 μm. Thus, a mechanical strength, durability and shot feel of the resulting golf ball are degraded.

The golf ball of Comparative Example 2 is a two-piece solid golf ball commercially available and Comparative Example 3 is a three-piece solid golf ball commercially available, and the both have less durability and shot feel than the golf balls of the present invention.

In Comparative Example 4, the outer core has a weight ratio of the ionomer to the rubber particles of 99:1, which an amount of the rubber component is little. The resulting golf ball has long flight distance, but poor shot feel.

In Comparative Example 5, the dynamically vulcanized rubber component is laminar, which is not particulate. Thus, durability and shot feel of the resulting golf ball are extremely degraded.

The golf ball of Comparative Example 6 is a two-piece golf ball comprising the core having single-layer structure, which is not two-layer structure, thus the difference in hardness between the outer core and the inner core is 0. In Comparative Example 7, the hardness of the outer core is smaller than that of the inner core. In comparison with the golf ball of the present invention, the golf ball of Comparative Example 6 has shorter flight distance, and that of Comparative Example 7 has shorter flight distance and poorer shot feel.

What is claimed is:

1. A multi-piece solid golf ball comprising a solid core consisting of an inner core and at least one outer core layer formed on the inner core, and a cover covering the solid core, wherein the inner core and outer core layer are formed from a material obtained by dispersing rubber in an ionomer resin and dynamically vulcanizing it with a vulcanizing agent, wherein the rubber particles dispersed in the ionomer resin have a particle size of not more than 10 $\mu$m, the outer core layer has a Shore D hardness of more than that of the inner core by 5 to 30, and a weight ratio of the ionomer resin to the rubber particles is within the range of 95:5 to 30:70.

2. The multi-piece solid golf ball according to claim 1 wherein the inner core has a Shore D hardness of 20 to 50, and the outer core layer has a Shore D hardness of 25 to 65.

3. The multi-piece solid golf ball according to claim 2 wherein the weight ratio of the ionomer resin to the rubber particles is within the range of 90:10 to 40:60.

4. The multi-piece solid golf ball according to claim 2 wherein the rubber particles have a particle size of from 0.001 to 5 $\mu$m.

5. The multi-piece solid golf ball according to claim 2 wherein the rubber particles have a particle size of not more than 2.5 $\mu$m.

6. The multi-piece solid golf ball according to claim 1 or claim 2 wherein the rubber particles for the outer core is formed from ethylene-propylene-diene rubber (EPDM), and the rubber particles for the inner core are formed from butadiene rubber.

7. The multi-piece solid golf ball according to claim 6 wherein the weight ratio of the ionomer resin to the rubber particles is within the range of 90:10 to 40:60.

8. The multi-piece solid golf ball according to claim 6 wherein the rubber particles have a particle size of from 0.001 to 5 $\mu$m.

9. The multi-piece solid golf ball according to claim 6 wherein the rubber particles have a particle size of not more than 2.5 $\mu$m.

10. The multi-piece solid golf ball according to claim 1 wherein the weight ratio of the ionomer resin to the rubber particles is within the range of 90:10 to 40:60.

11. The multi-piece solid golf ball according to claim 1 wherein the rubber particles have a particle size of from 0.001 to 5 $\mu$m.

12. The multi-piece solid golf ball according to claim 1 wherein the rubber particles have a particle size of not more than 2.5 $\mu$m.

* * * * *